US007043035B2

(12) United States Patent
Rittersma et al.

(10) Patent No.: US 7,043,035 B2
(45) Date of Patent: May 9, 2006

(54) MINIATURE MICROPHONE

(75) Inventors: Zacharias M. Rittersma, Leuven (BE); Alwin Fransen, PX Delft (NL); Hendrik Dolleman, Assendelft (NL)

(73) Assignee: SonionMicrotronic Nederland B.V., Amsterdam (NL)

( * ) Notice: Subject to any disclaimer, the term of this patent is extended or adjusted under 35 U.S.C. 154(b) by 222 days.

(21) Appl. No.: 10/149,215

(22) PCT Filed: Dec. 7, 2000

(86) PCT No.: PCT/US00/42649

§ 371 (c)(1),
(2), (4) Date: Oct. 15, 2002

(87) PCT Pub. No.: WO01/43489

PCT Pub. Date: Jun. 14, 2001

(65) Prior Publication Data

US 2003/0103639 A1 Jun. 5, 2003

Related U.S. Application Data

(60) Provisional application No. 60/169,881, filed on Dec. 9, 1999.

(51) Int. Cl.
*H04R 25/00* (2006.01)

(52) U.S. Cl. ..... 381/173; 381/191; 381/430

(58) Field of Classification Search ..... 381/355, 381/360, 369, 170, 173–176, 190–191, 396, 381/430; 367/158; 310/337, 358; 181/154, 181/165

See application file for complete search history.

(56) References Cited

U.S. PATENT DOCUMENTS

| | | | | |
|---|---|---|---|---|
| 2,490,236 | A | 12/1949 | Shaper | 171/327 |
| 3,068,446 | A | 12/1962 | Ehrlich et al. | 340/8 |
| 4,063,049 | A | 12/1977 | Pipitone et al. | 179/110 A |
| 4,550,227 | A | 10/1985 | Topholm | 179/107 E |
| 4,607,720 | A | 8/1986 | Hardt | 181/135 |
| 4,634,815 | A | 1/1987 | Marquis | 387/68.4 |
| 4,736,430 | A | 4/1988 | Schröder | 381/68.6 |
| 4,739,512 | A | 4/1988 | Hartl et al. | 381/68.6 |
| 4,764,690 | A | 8/1988 | Murphy et al. | 307/400 |
| 4,850,023 | A | 7/1989 | Yarush | 381/67 |
| 4,852,177 | A | 7/1989 | Ambrose | 381/154 |
| 4,903,308 | A | 2/1990 | Paddock et al. | 381/202 |
| 4,993,072 | A | 2/1991 | Murphy | 381/113 |
| 5,048,090 | A | 9/1991 | Geers | 381/68.6 |
| 5,097,515 | A | 3/1992 | Baba | 381/191 |

(Continued)

FOREIGN PATENT DOCUMENTS

JP 11266499 A 9/1999

(Continued)

*Primary Examiner*—Suhan Ni
(74) *Attorney, Agent, or Firm*—Jenkens & Gilchrist

(57) ABSTRACT

A microphone for converting sound into an electrical signal includes a generally cylindrical housing including an inlet for receiving sound, an inner backplate, and an outer backplate. The inner and outer backplates are generally cylindrical and substantially concentric with each other. A cylindrical membrane is disposed between the inner and outer backplates. The membrane divides an interior of said housing into a front volume and a back volume. The front volume is in direct communication with the inlet. The backplates and/or membrane are charged. Electronics are included for detecting movement of the membrane relative to the inner and outer backplates in response to the membrane moving when subjected to the sound. The backplates and membrane may be of a shape that approximates a cylinder, such as those that have a hexagonal or octagonal cross-section.

41 Claims, 4 Drawing Sheets

U.S. PATENT DOCUMENTS

| | | | | |
|---|---|---|---|---|
| 5,220,612 | A | 6/1993 | Tibbetts et al. | 381/68 |
| 5,335,286 | A | 8/1994 | Carlson et al. | 381/191 |
| 5,373,555 | A | 12/1994 | Norris et al. | 379/430 |
| 5,408,534 | A | 4/1995 | Lenzini et al. | 381/191 |
| 5,530,763 | A | 6/1996 | Aebi et al. | 381/69 |
| 5,548,658 | A | 8/1996 | Ring et al. | 381/181 |
| 5,570,428 | A | 10/1996 | Madaffari et al. | 381/191 |
| 5,740,261 | A | 4/1998 | Loeppert et al. | 381/168 |
| 5,828,766 | A | 10/1998 | Gallo | 381/190 |
| 5,859,916 | A | 1/1999 | Ball et al. | 381/326 |
| 5,881,158 | A | 3/1999 | Lesinski et al. | 381/174 |
| 6,075,869 | A | 6/2000 | Killion et al. | 381/313 |
| 6,201,874 | B1 * | 3/2001 | Croft et al. | 381/191 |
| 6,351,543 | B1 * | 2/2002 | Lenhard-Backhaus et al. | 381/355 |

FOREIGN PATENT DOCUMENTS

| | | | |
|---|---|---|---|
| JP | 2000050394 | A | 2/2000 |
| WO | WO 00/41432 | A2 | 7/2000 |
| WO | WO 01/43489 | A2 | 6/2001 |

* cited by examiner

MINIATURE MICROPHONE

This application claims the benefit of Provisional Application No. 60/169,881, filed Dec. 9, 1999.

FIELD OF THE INVENTION

This invention relates generally to electroacoustic transducers and, in particular, to an electroacoustic transducer that has a generally cylindrical shape or a polygonal shape that approximates cylinder. Such a transducer is particularly useful in hearing aids and similar listening devices.

BACKGROUND OF THE INVENTION

Electroacoustic transducers which convert electrical energy into sound energy, and vice versa, have been known for decades. They are useful for various purposes, including hearing aids and listening devices that fit within the ear canal. In a hearing aid, there are generally two electroacoustic transducers. The first one is a microphone which receives sound from the environment and converts that sound into an acoustical electrical signal. That signal, an audio signal, is then amplified and sent to the second transducer, which is the speaker. The speaker converts the amplified audio signal into a corresponding amplified sound wave that is then sent towards the eardrum of the person wearing the hearing aid or listening device.

Because it is desirable to have these devices as small as possible so that they fit easily within the ear canal of the patient, there is a strong need for miniature electroacoustic transducers. Numerous electroacoustic transducers are available which have a square shape. This square shape does not, however, result in an optimal use of space and a larger volume is needed for the transducer.

Therefore, a need exists for a transducer that has the same or better sound sensitivity, but is more efficiently packaged.

SUMMARY OF THE INVENTION

The present invention relates to a microphone that has a generally cylindrical housing in which the working components are contained. A pair of concentric, generally cylindrical backplates are located within the housing and are separated from each other by a gap. Each of the backplates includes a plurality of openings through which sound can pass. A membrane is located within the gap between the backplates and is at a known distance from each of the backplates. Preferably, the cylindrical housing contains electronics, such as an integrated circuit, to receive and process the electrical signals from the backplates and membrane.

One of the ends of the generally cylindrical housing includes an inlet tube into which sound propagates. In one embodiment, the sound moves within the cylindrical region of the first inner backplate and then through a plurality of openings to encounter the membrane. Due to the pressure change associated with a particular sound, the membrane will expand radially outward. Thus, the position of the membrane within the gap between the backplates will change. In another embodiment, the sound enters the tube and is directed radially outward towards the inner surface of the cylindrical housing. The sound moves through the region defined by the housing and the outer backplate and then through the openings in the outer backplate. The sound then causes the membrane to contract radially inward.

When the backplates and/or membrane are charged, the membrane's movement produces an electrical signal that is detected by the electronics (e.g., an integrated circuit), whether the electronics are located within or outside of the housing. Thus, a particular sound will result in a particular electrical signal.

In one embodiment, the backplates are charged and the membrane is a flexible polymeric film having two uncharged metallized surfaces. In another embodiment, the membrane is charged and the two backplates are not charged, but are merely metallic. In a further embodiment, both the backplate and the membrane are charged. In any of these embodiments, a deflection of the membrane caused by sound energy results in a detectable electrical signal that is monitored by the accompanying electronics.

In yet another embodiment, neither the backplates nor the membrane is charged, but both have conductive metal surfaces. Any deflection of the membrane causes a change in the capacitance as measured between the membrane and the backplates. That change in capacitance is detected by the electronics.

Furthermore, the backplates and membrane can have a cross-section that is polygonal such that the cross-sectional shape approximates a circle. For example, the backplates and membrane can be arranged in a hexagonal shape or an octagonal shape. While the housing could also have a similar shape, this configuration would still allow for the use of a generally cylindrical housing.

Because of the generally cylindrical shape, the area of the membrane can be maximized for a particular volume. Thus, due to the larger area of the membrane, the sensitivity of the microphone can be increased.

The above summary of the presented invention is not intended to represent each embodiment, or every aspect of the present invention. This is the purpose of the figures and detailed description which follow.

BRIEF DESCRIPTION OF THE DRAWINGS

The foregoing and other advantages of the invention will become apparent upon reading the following detailed description and upon reference to the drawings.

Figure 1:
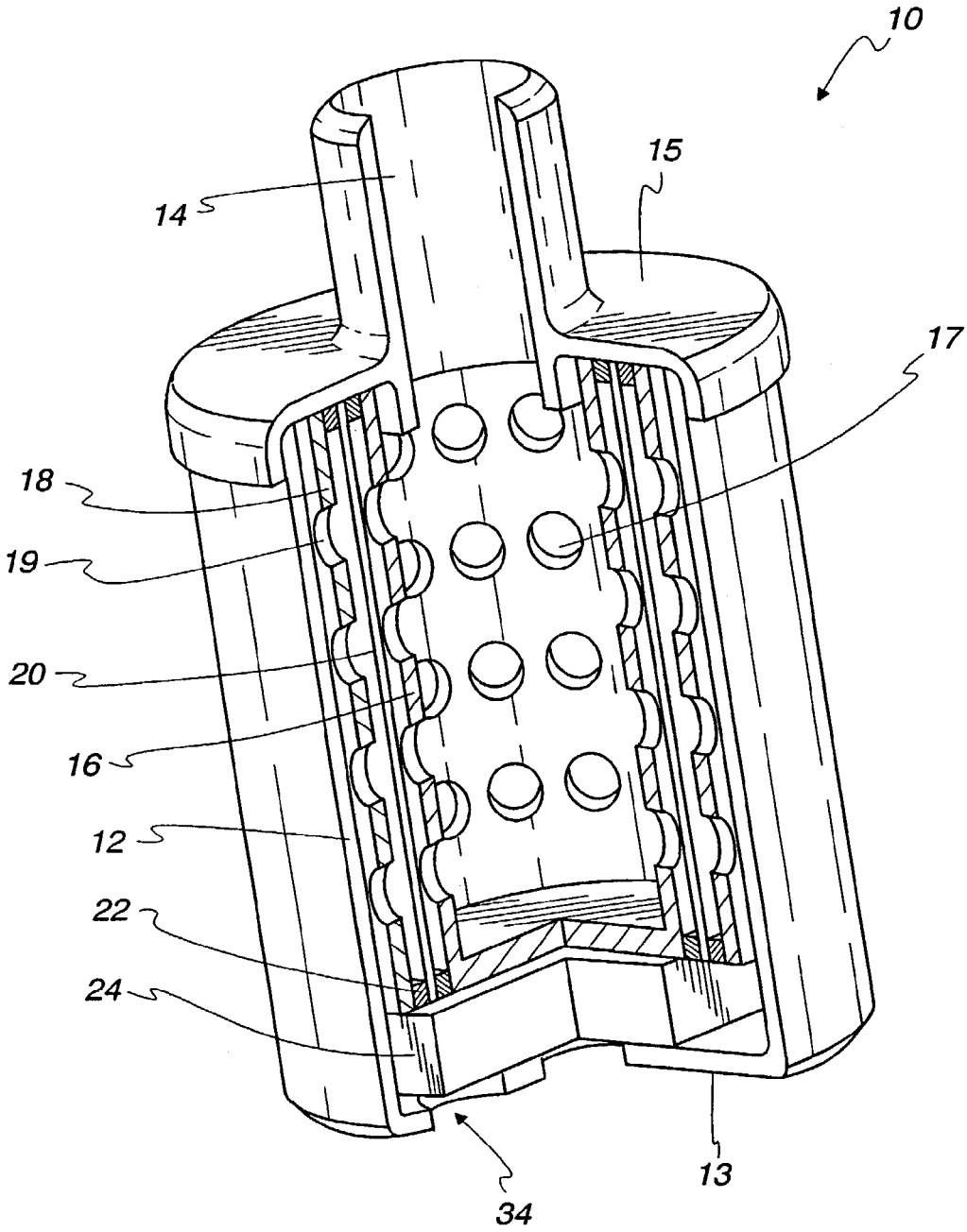
FIG. 1 is a partial cut-away view of the cylindrical microphone according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE DRAWINGS

Figure 2:
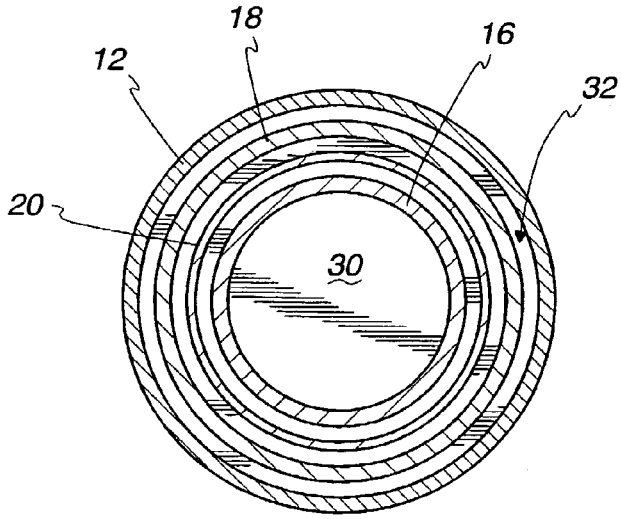
FIG. 2 is a cross-section view perpendicular to the central axis of the microphone of FIG. 1.

Referring now to FIGS. 1 and 2, a cylindrical microphone 10 includes a cylindrical housing 12 having a base 13. Opposing the base 13 is an inlet tube 14. The inlet tube 14 includes a circular portion 15 that fits around and engages the outer periphery of the housing 12 at its upper end.

An inner backplate 16 is located inside the housing 12 and has an internal cylindrical region in communication with the inlet tube 14. The inner backplate 16 includes a plurality of openings 17 which allow sound to move radially outward from the inner backplate 16. An outer backplate 18 is located radially outward from the inner backplate 16 and is adjacent to the inner surface of the housing 12. The outer backplate 18 also includes a plurality of openings 19. A membrane 20 is placed at a known distance between the inner backplate 16 and the outer backplate 18. To help define the distance between the membrane 20 and the inner and outer backplates 16, 18, and also to provide an acoustical seal around the membrane 20, a plurality of seals 22 are located at the upper and lower ends of the membrane 20. The seals 22 are non-conductive and can be made of a polymeric material, an elastomer, an adhesive, or combinations thereof.

If the seals 22 do not provide the necessary spacing between the membrane 20 and the backplates 16, 18, non-conductive spacers may be placed at various locations on the backplates 16, 18. These spacers can be small round spacers at various circumferential and axial positions, or they may be narrow elongated strips extending axially at two or three circumferential locations (i.e., 180° or 120° apart).

The outer backplate 18 should be fixed relative to the cylindrical housing 12. This can be done by having stand-offs located between the outer surface of the outer backplate 18 and the inner surface of the cylindrical housing 12. The stand-offs may include a layer of adhesive or epoxy to maintain the relative positioning of the outer backplate 18 to the cylindrical housing 12 after assembly. Further, the inner backplate 16 should be fixed relative to the outer backplate 18. This can be done by placing a layer of the adhesive or epoxy at the axial lower and/or upper edges of the backplates 16, 18 adjacent to (or over) the seals 22. As mentioned above, the seals 22 can also serve to maintain the relative positioning of the backplates 16, 18 to the membrane 20. It is also possible to fix the relative positions of the backplates 16, 18 by applying a layer of epoxy or adhesive to the underside of the circular portion 15 of the inlet tube 14. Thus, the inlet tube 14, backplates 16, 18, and membrane 20 can be made as one sub-assembly that fits within the cylindrical housing 12.

The housing 12 contains the electronics 24 that detect the electrical signals produced by the movement of the membrane 20. Accordingly, the electronics 24 are connected to the membrane 20 and the backplates 16, 18. The electronics 24 are preferably an integrated circuit and include a preamplifier and also, most preferably, an amplifier. The electronics 24 may also include an A/D converter to result in digital output. Such an A/D converter requires a signal from a clock which can be internal to the electronics 24 or brought in from an external source. While FIG. 1 illustrates the electronics 24 being located inside the housing 12, the present invention contemplates a cylindrical microphone 10 that has its associated electronics 24 located outside the housing 12. If that is the case, the microphone 10 can be made even smaller.

The inner backplate 16 defines a volume of air known as "the front volume" 30. The front volume 30 is in acoustical communication with the inlet tube 14. The outer backplate 18 and the inner surface of the housing 12 define a volume of air known as "the back volume" 32. In practice, sound enters the inlet tube 14 and encounters the front volume 30. The sound then travels through the openings 17 in the inner backplate 16 and reaches the membrane 20. Due to the pressure associated with the sound, the membrane 20 deflects radially outward towards the outer backplate 18. The movement of the membrane 20 forces the air between the membrane 20 and the outer backplate 18 to move through the openings 19 in the outer backplate 18 and into the back volume 32. In one embodiment, the base 13 of the housing 12 may include an aperture 34 that is in communication with the back volume 32. As shown, the aperture 34 is adjacent to the electronics 24 at the base 13 and can also serve as a port for electrical connection. In an alternative embodiment, the membrane 20 may include a small pressure compensation hole (e.g., 5 microns in diameter) to ensure equal pressure on both sides of the membrane 20 at equilibrium, if the aperture 34 is not present.

Because the sensitivity of the microphone is proportional to the area of the membrane 20 that is exposed to the sound, the cylindrical microphone 10 allows for more surface area of the membrane 20 within a given volume compared with the standard square microphones which utilize a rectangular membrane. Further, by using concentric cylinders for the backplates 16, 18 and the membrane 20, the membrane 20 and the backplates 16, 18 can be separated by fixed, small distances, which is beneficial for the operation of the microphone. Thus, the cylindrical microphone 10 is an improvement over the known square microphones.

In one preferred embodiment, the outer surface of the inner backplate 16 is covered with a flexible material having a fixed charge. One type of flexible charged material that is particularly useful in developing this charge is an electromagnetic film ("EMFi") that is disclosed in U.S. Pat. Nos. 4,654,546 and 5,757,090 to Kidjavinen, both of which are herein incorporated by reference in their entireties. A similarly charged film is placed on the inner surface of the outer backplate 18. The membrane 20 in this embodiment is typically polymeric film with a double-sided metallization. For example, the membrane 20 can be made of Mylar® with a metal coating on its surfaces. At equilibrium, the membrane 20 is balanced between the two charged surfaces of the backplates 16, 18. When the membrane 20 moves, the change in voltage between the membrane 20 and the inner backplate 16 is detected, as is the change in voltage between the membrane 20 and the outer backplate 18. Consequently, a predetermined sound entering the inlet tube 14 passing through the front volume 30 and displacing the membrane 20 will result in a detectable signal that is monitored by the electronics 24.

Because any movement of the membrane 20 results in two signals, one corresponding to the voltage change between the membrane 20 and the inner backplate 16 and the other corresponding to the voltage change between the membrane 20 and the outer backplate 18, better sensitivity of the microphone 10 is achieved. Additionally, this also enhances linearity because the displacement-dependent charge redistribution is cancelled out.

When the EMFi material is used, it is preferably arranged in a manner so as not to overlay or otherwise interfere with the openings 17, 19 on the inner and outer backplates 16, 18. One way to do this is to develop a grid (axial and circumferential components) of EMFi material that is located on portions of the surfaces of the backplates 16, 18 that do not intersect with the openings 17, 19. Because the EMFi material has a fixed charge, the backplates 16, 18 can be made of the metallic material and the electronics 24 will be contacted to the backplate for measuring the voltage on each structure. The fixed surface charge in the EMFi material will not be distorted by having the metallic structure contact it on its backside.

An alternative to having the EMFi material on the inner and outer backplates 16, 18 can be developed by using a charged polymer such as Teflon® for the backplates 16, 18. Regardless of the method by which a fixed charge is placed on the surfaces of the inner and outer backplates 16, 18, the charging of the backplates 16, 18 preferably occurs prior to assembly.

Unlike the orientation in a standard square microphone whereby the flat membrane becomes curved and moves towards a flat backplate when subjected to sound, the cylindrical microphone 10, due to its geometry, results in a further curving of the already curved membrane 20 (i.e., the membrane 20 has a cylindrical surface which experiences localized changes in its radius). Because the inner and outer backplates 16, 18 are also curved, the resulting increased or decreased radius on any given region of the membrane 20 is confronted by a curved inner and outer backplate 16, 18. Consequently, the cylindrical shape also improves microphone sensitivity and linearity for this reason.

To construct the membrane 20, a rectangular piece of material is cut and metallized. The rectangular membrane 20 is then wound so as to produce a cylinder. A seam is then created at the ends of the rectangular membrane after being wound into a cylinder. The seam may be made from various materials. Preferably, this seam is a fixed seam in which the ends of the rectangle have no relative movement.

Also, it is possible to make the housing 12 from a flexible material to fit within tightly confined spaces.

Due to the axial symmetry of the microphone 10, any undesirable vibration of the microphone 10 causes the membrane 20 to move closer to the inner backplate 16 on one side and to the outer backplate 18 on the other side (i.e., the membrane 20 shifts in the same direction at various points on its circumference). The result is that the two signals from such a vibration should tend to cancel each other. As such, the cylindrical design of the microphone 10 provides for improved signal output with less distortion from vibration.

Because the EMFi material described above is piezoelectric, placing a metal electrode on either side of the EMFi material allows for feedback caused by vibration of 30 one or both of the backplates 16, 18. If metal is placed on the exposed outer surface of the EMFi material (the inner surface already being in contact with the backplate 16 or 18), however, the ability of the backplate 16 or 18 to interact with the membrane 20 is locally eliminated at that point where the metal is placed. As such, the present invention contemplates placing one or more small metal electrodes on the exposed outer surface of the EMFi material for the purpose of measuring the voltage across the EMFi material. When a vibration is encountered, it will be detected as a signal across the EMFi material at one or more locations on one or both of the backplates 16, 18 due to the piezoelectric effect. Consequently, the EMFi material in such a system is useful for measuring undesirable vibration by itself and the incoming acoustic energy in conjunction with the membrane 20.

While FIG. 1 has been described as having its backplates 16, 18 charged while the membrane 20 is metallic, the microphone 10 could also operate by having the membrane 20 charged. In such a case, the EMFi material can be used as the membrane 20 and would interact with the charged backplates 16, 18. Other flexible charged films can also be used.

In a further embodiment, the membrane 20 can be charged while the backplates 16, 18 are metallic. Again, this embodiment requires the membrane 20 to be made of the EMFi material (or another charged flexible film) and the backplates 16, 18 would be made of a conductive metal, such as stainless steel.

Finally, it is possible to use the microphone 10 in a manner where neither the backplates 16, 18 nor the membrane 20 is charged. In such an embodiment, each of these components is metallic and the deflection of the membrane 20 results in a change of capacitance between the surfaces.

It should also be noted that the microphone 10 can operate with only one backplate 16 or 18. Thus, the signal that is received during deflection is only sensed between the membrane 20 and the one remaining backplate 16 or 18. In this embodiment, the membrane 20 is not "balanced" as in the embodiment illustrated in FIG. 1.

Figure 3:
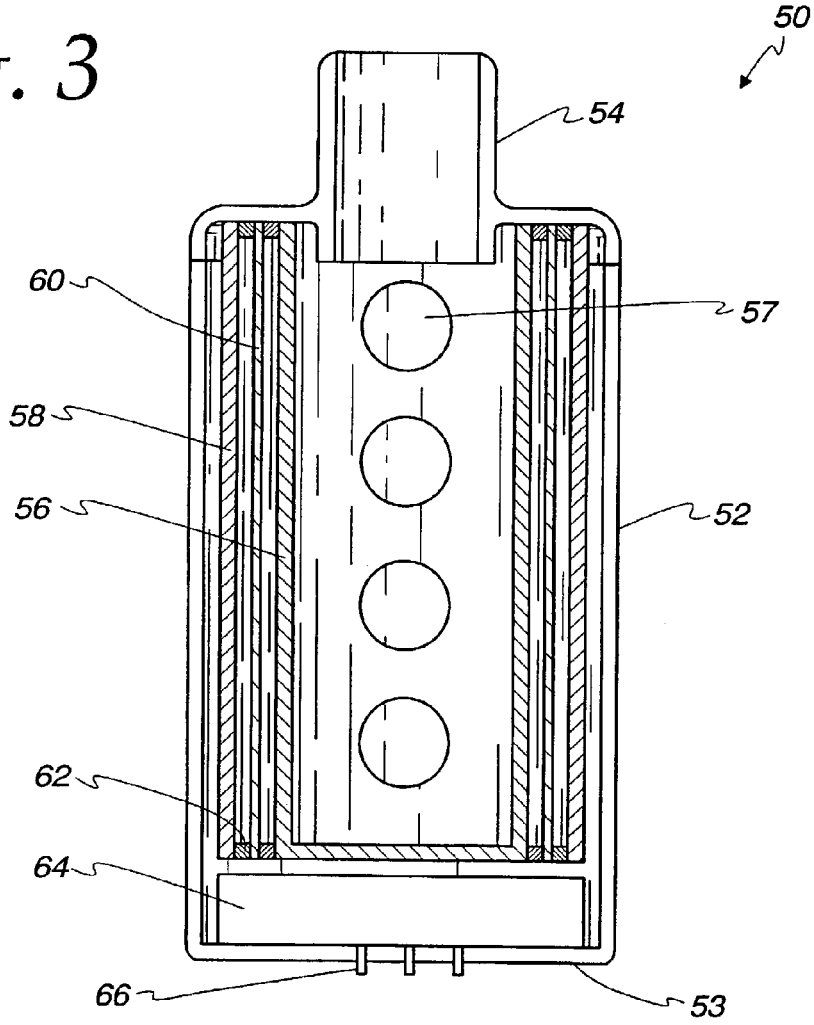
FIG. 3 is a longitudinal sectional view of an alternative cylindrical microphone that is similar to the microphone of FIG. 1.

FIG. 3 illustrates a cylindrical microphone 50 which is very similar to the cylindrical microphone 10 of FIG. 1. The microphone 50 includes a cylindrical housing 52 having an inlet tube 54 at its upper end. An inner backplate 56, an outer backplate 58, and a membrane 60 are in the same relationship as stated with respect to FIG. 1. A plurality of seals 62 are located between the backplates 56 and 58 and the membrane 60. The electronics 64 for controlling the microphone 50 are also located within housing 52.

One noticeable difference between FIGS. 1 and 3 is that the openings 57 in the inner backplate 56 are much larger. As such, the openings 57 (or the opening 57) can be various sizes and shapes and are selected to present the optimum acoustical inertance for the incoming sound that best suits the desired application for the microphone 50. Preferably, the ratio of the area of the openings 57 to the structural area of the backplates is from about 0.25 to about 0.5. The openings 57 can also be axially extending rectangular slots. The flexible charged film can be placed on the backplates 56, 58 in the regions outside those slots (i.e., axial stripes of charged film).

Another difference between FIGS. 1 and 3 is that the aspect ratio of the cylindrical housing 52 has changed so that the membrane 60 is longer and, thus, has more surface area. Because the membrane 60 has a larger axial distance, it is less stiff and more sensitive to sound. Thus, the present invention contemplates various aspect ratios for the cylindrical housings.

Further, the base surface 53 of the housing 52 does not include an aperture. Thus, the back volume between the outer backplate 58 and the cylindrical housing 52 is closed. In some applications, this may be more beneficial to the operation of the microphone 50 in comparison to the microphone 10 of FIG. 1, which has aperture 34 on its base 13. The membrane 60, however, must have a pressure compensation hole connecting the front and back volumes in FIG. 3.

FIG. 3 also illustrates a plurality of terminals 66 extending from the base 53 of the microphone 50. While the view of FIG. 1 did not illustrate these terminals, terminals similar to terminals 66 are present in the microphone 10 of FIG. 1. These terminals 66 provide the input power for the electronics 64 and the acoustical output signal. The terminals 66 may also be flat contacts instead of the projecting terminals that are illustrated. Further, the terminals 66 may be in the form of "flex print" (i.e., a flexible printed circuit board)

which is located within the housing 52 and has its end portions for electrical connection located outside the base surface 53.

Figure 4:
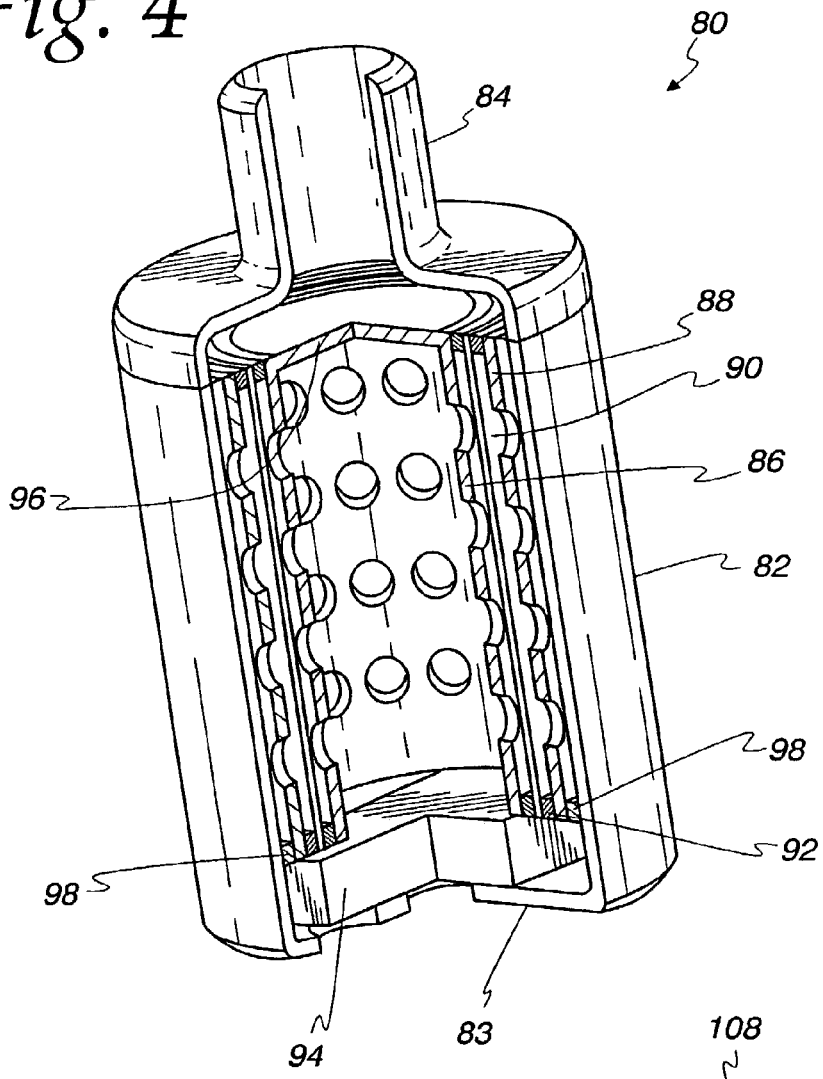
FIG. 4 is a partial cut-away view of yet another cylindrical microphone according to the present invention.

FIG. 4 illustrates a particularly preferred embodiment of a cylindrical microphone 80 which is similar to the previous microphone, except that the front volume and back volume have been switched. The microphone 80 includes a cylindrical housing 82 having an inlet tube 84 at its upper end. An inner backplate 86, an outer backplate 88, and a membrane 90 are in the same relationship as stated with respect to FIGS. 1 and 3. A plurality of seals 92 are located between the backplates 86 and 88 and the membrane 90. The electronics 94 for controlling the microphone 80 are also located within housing 82.

The inner backplate 86 includes a top surface 96 that prohibits the sound that enters the inlet tube 84 from entering the cylindrical region defined within the inner backplate 86. Instead, the sound moves radially outward and passes between the space defined between the inner surface of the cylindrical housing 82 and the outer backplate 88. Thus, the region defined between the inner surface of the cylindrical housing 82 and the outer backplate 88 is now the front volume in FIG. 4. A front volume seal 98 is located at the bottom of the outer back plate 88 and ensures that the sound moves through the openings in the outer backplate 88 and acts on the membrane 90. In this embodiment, the membrane 90 deflects radially inward towards the inner backplate 86 when subjected to sound energy.

In FIG. 4, the area within the inner backplate 86 is now the back volume. It is desirable to have a large back volume and a smaller front volume and the embodiment of FIG. 4 accomplishes this result. The lower portion of the inner backplate 86 is open and exposed to the electronics 94. The base 83 of the housing 82 contains an aperture leading to the ambient environment for pressure compensation, but may lack one as well if the membrane 90 has a pressure compensation aperture.

If the microphone 80 is used with one electret, then only one of the backplates 86, 88 is needed. Of course, the membrane 90 is not a "balanced" membrane in this embodiment since there is only one charged plate on one of its sides.

It should be noted that the microphones 10, 50, 80, when including openings in their respective bases of the housing, could be used as a directional microphone. The openings at the base of the housing would include inlet tubes similar to those inlet tubes 14, 54, 84 on the ends of the housings 12, 52, 82. Here, the sound enters the front and back volumes to act on the membrane. The corresponding signals from the membrane can be processed to determine the direction of the source of the sound. A filter, such as a mesh membrane, may be added to improve the performance of the directional microphone.

Figure 5:
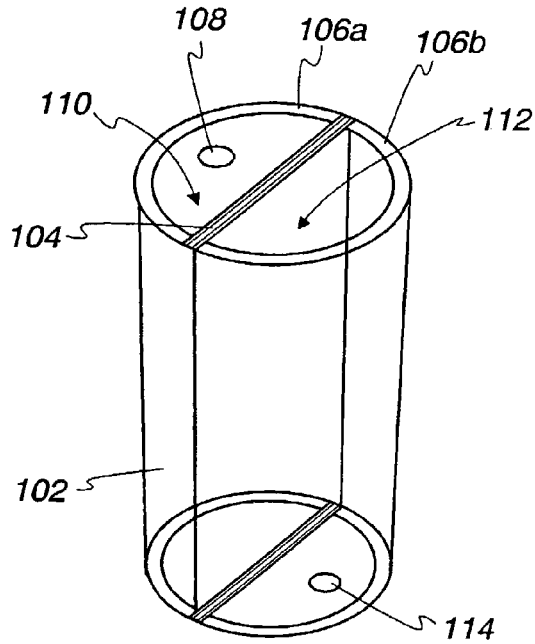
FIG. 5 illustrates a further embodiment of the cylindrical microphone having a planar membrane and two curved backplates.

FIG. 5 illustrates a microphone 100 that has a cylindrical housing 102 but, unlike the previous embodiments, has a planar membrane 104 with double-sided metallization. A pair of charged backplates 106*a*, 106*b* is located on either side of the membrane 104. A sound inlet 108 is located on one end of the housing 102 and leads to a front volume 110. On the opposite side of the membrane 104 is a back volume 112. A pressure compensation opening 114 is located on the bottom end of the cylindrical housing 102. As with the previous embodiments, a compensation opening may be placed in the membrane 104 as an alternative to the pressure compensation opening 114 in the housing 102.

To reduce the size of the front volume 110, a material may be placed within the front volume 110 to limit the size of the path through which the sound propagates. In a further embodiment, the left backplate 106*a* can be removed and the housing 102 can be made into a D-shape, when viewed along its major axis. The sound inlet 108 would be in communication with a narrow rectangular channel exposed to the membrane 104. Of course, there would be only one backplate 106*b* interacting with the membrane. In any of the embodiments shown in FIG. 5, the electronics could be placed within the housing 102.

Figure 6A:
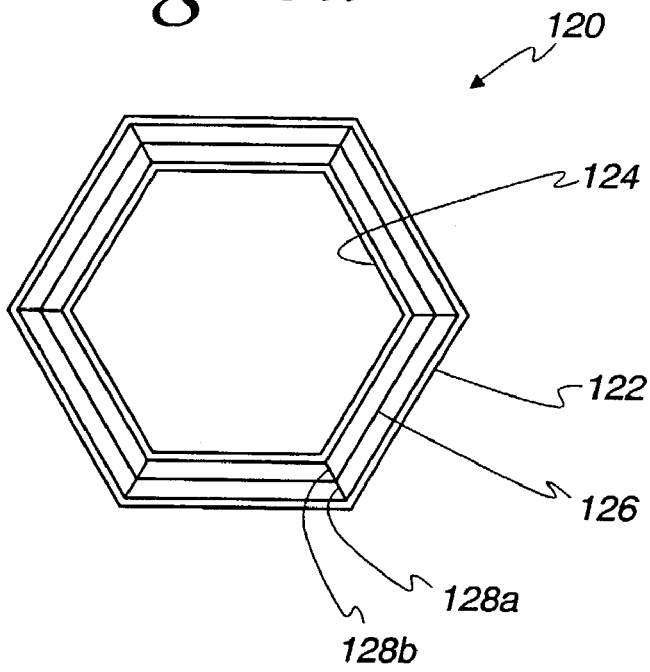
FIGS. 6A and 6B illustrate another embodiment of the present invention which utilizes backplates and a membrane with a polygonal shape that approximates a cylinder.
Figure 6B:
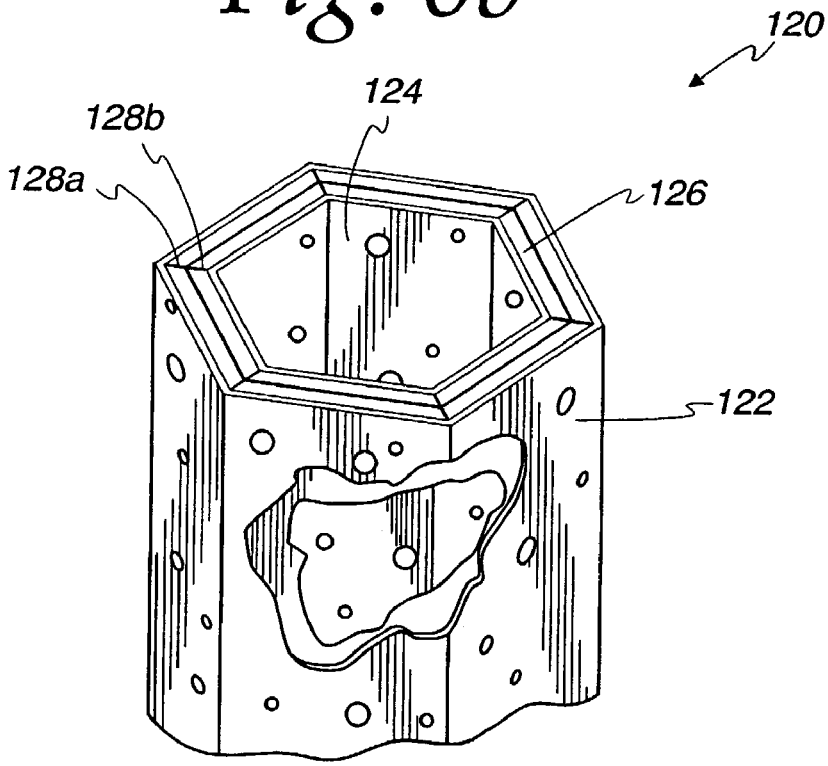

FIGS. 6A and 6B illustrate a different embodiment of the present invention. Here, the assembly 120 includes an outer backplate 122, and inner backplate 124, and a membrane 126 positioned between the two backplates 122, 124. The assembly can be configured to operates in the same manner as any of the previous embodiments. The main difference is that a cross section taken in the direction in which the membrane 126 primarily moves (i.e. FIG. 6A) reveals a polygonal shape that approximates a circle, rather than being a circle. In this case, the polygonal shape is a hexagon. Other polygonal shapes, such as a pentagon, an octagon, or a decagon, are available as well. Another difference is that the openings in the backplates 122 and 124 can be randomly oriented and have various sizes along the backplates 122 and 124. Of course, the openings can also be configured like those in the previous embodiments.

The corners of the polygon of the outer backplate 122 are connected to the membrane 126 by studs 128*a*, which maintain the appropriate distance between the membrane 126 and the outer backplate 122. Similarly, studs 128*b* connect the inner backplate 124 with the membrane 126. The studs 128*a*, 128*b* serve the same function as the seals 22 mentioned above in FIG. 1. The studs 128*a*, 128*b* may be along the entire length of the assembly 120, or may be at spaced locations along the length.

The assembly 120 of FIGS. 6A and 6B can be manufactured in various ways. In one method, six segments are used with each segment having a one-sixth section of the outer backplate 122, a one-sixth section of the inner backplate 124, and a one-sixth section of the membrane 126. Each segment is then connected to produce the final assembly 120. Because each of the segments contain planar components, the distance between membrane 126 and backplates is easier to control.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A microphone for converting sound into an electrical signal, comprising:

a housing including an inlet for receiving a sound;

a membrane located within said housing and having a shape that at least approximates a cylinder; and a structure within said housing and being located concentrically at a known distance relative to said membrane and further having a shape substantially the same as said shape of said membrane, said sound causing movement of said membrane relative to said structure, said movement creating detectable signals from said membrane and said structure corresponding to said sound.

2. The microphone of claim 1, wherein only one of said membrane and said structure is charged.

3. The microphone of claim 1, wherein said membrane approximates a cylinder by having a plurality of flat sides.

4. The microphone of claim 1, wherein said structure has a cylindrical shape.

5. A microphone for converting sound into an electrical signal, comprising:

a housing including an inlet for receiving sound;

an inner backplate within said housing and being generally cylindrical;

an outer backplate within said housing and being generally cylindrical, said outer backplate being substantially concentric with said inner backplate;

a generally cylindrical membrane being disposed between said inner and outer backplates and having a shape that is substantially the same as the shape of said inner backplate and of said outer backplate, said membrane dividing an interior of said housing into a front volume and a back volume, said front volume being in direct communication with said inlet; and contacts on said membrane and said backplates for transmitting signals associated with certain movements of said membrane relative to said backplates.

6. The microphone of claim 5, wherein only said membrane is charged.

7. The microphone of claim 5, wherein said backplates are charged.

8. The microphone of claim 5, wherein a part of said front volume is within said inner backplate.

9. The microphone of claim 5, wherein a part of said front volume is between said cylindrical housing and said outer backplate.

10. The microphone of claim 5, further including electronics within said housing, said electronics being connected to said contacts.

11. A microphone for converting sound into an electrical signal, comprising:

a housing;

a structure located within said housing;

a membrane located within said housing and being at a known distance from said structure, said membrane being capable of movement relative to said structure, said membrane having a cross-section taken generally in the direction of said movement that at least approximates a circular shape, said structure also having a cross-section that is substantially the same as said cross-section of said membrane, at least one of said membrane and said structure being charged; and electronics for detecting said movement of said membrane relative to said structure in response to said membrane being subjected to sound.

12. The microphone of claim 11, wherein said membrane is substantially cylindrical so as to produce a substantially circular cross-sectional shape.

13. The microphone of claim 11, wherein said structure is curved.

14. The microphone of claim 13, wherein said structure is cylindrical.

15. The microphone of claim 11, wherein said membrane has a substantially hexagonal cross-sectional shape.

16. The microphone of claim 11, wherein said structure has a substantially hexagonal cross-sectional shape.

17. The microphone of claim 16, further including a second structure opposing said structure, said membrane being located between said two structures, said second structure having a substantially hexagonal cross-sectional shape.

18. The microphone of claim 11, wherein said housing is generally cylindrical.

19. The microphone of claim 3, wherein said membrane has a hexagonal shape.

20. The microphone of claim 3, wherein said structure approximates a cylinder by having the same number of flat sides as said membrane.

21. The microphone of claim 1, wherein an outer surface of said membrane opposes an inner surface of said structure.

22. The microphone of claim 1, wherein an inner surface of said membrane opposes an outer surface of said structure.

23. The microphone of claim 1, wherein said structure is a backplate.

24. The microphone of claim 1, further comprising a second structure within said housing and being located concentrically at a known distance relative to said membrane and said structure and further having a shape substantially the same as said shape of said membrane.

25. The microphone of claim 1, wherein said structure is an inner backplate and said second structure is an outer backplate.

26. The microphone of claim 25, wherein said inner backplate is charged or said outer backplate is charged or both are charged.

27. The microphone of claim 1, wherein said membrane has a substantially planar surface.

28. The microphone of claim 5, wherein said membrane has a substantially planar surface.

29. The microphone of claim 11, wherein said membrane has a substantially planar surface.

30. The microphone of claim 12, wherein said structure is substantially cylindrical so as to produce a substantially circular cross-sectional shape.

31. The microphone of claim 13, wherein said membrane is cylindrical.

32. The microphone of claim 14, wherein said membrane is cylindrical.

33. The method of claim 16, wherein said membrane has a substantially hexagonal cross-sectional shape.

34. A microphone, comprising:

a housing having an inlet for receiving a sound;

a generally cylindrically shaped membrane within said housing;

a generally cylindrically shaped backplate concentric with said membrane, said membrane moving in response to said sound relative to said backplate, said movement creating detectable signals from said membrane and said structure corresponding to said sound, said membrane or said backplate being charged; and electronics for detecting said movement of said membrane relative to said structure in response to said membrane being subjected to sound and producing an electrical signal corresponding to said sound.

35. The microphone of claim 34, wherein said membrane has a cylindrical shape.

36. The microphone of claim 34, wherein said backplate has a cylindrical shape.

37. The microphone of claim 35, wherein said backplate has a cylindrical shape.

38. The microphone of claim 34, wherein said backplate is an inner backplate, the microphone further comprising an outer backplate concentric with said inner backplate and said membrane, said membrane disposed between said inner and outer backplates.

39. The microphone of claim 38, wherein said outer backplate is charged.

40. The microphone of claim 34, wherein said movement causes a change in capacitance between said membrane and said backplate, said electronics measuring said capacitance to produce said electrical signal.

41. The microphone of claim 4, wherein said membrane has a generally cylindrical shape.

* * * * *

UNITED STATES PATENT AND TRADEMARK OFFICE

CERTIFICATE OF CORRECTION

PATENT NO. : 7,043,035 B2
APPLICATION NO. : 10/149215
DATED : May 9, 2006
INVENTOR(S) : Zacharias M. Rittersma et al.

It is certified that error appears in the above-identified patent and that said Letters Patent is hereby corrected as shown below:

In column 9, line 13, after the word "membrane" delete the word "being".

Signed and Sealed this

Twenty-second Day of August, 2006

JON W. DUDAS
*Director of the United States Patent and Trademark Office*